US011022913B2

(12) United States Patent
Sandler et al.

(10) Patent No.: US 11,022,913 B2
(45) Date of Patent: Jun. 1, 2021

(54) CARRIER EVAPORATORS FOR LIQUID ELECTROPHOTOGRAPHY PRINTING

(71) Applicant: HP INDIGO B.V., Amstelveen (NL)

(72) Inventors: Mark Sandler, Ness Ziona (IL); Peter Nedelin, Ness Ziona (IL)

(73) Assignee: HP Indigo B.V., Amstelveen (NL)

( * ) Notice: Subject to any disclaimer, the term of this patent is extended or adjusted under 35 U.S.C. 154(b) by 0 days.

(21) Appl. No.: 16/607,008

(22) PCT Filed: May 4, 2017

(86) PCT No.: PCT/EP2017/060722
§ 371 (c)(1),
(2) Date: Oct. 21, 2019

(87) PCT Pub. No.: WO2018/202308
PCT Pub. Date: Nov. 8, 2018

(65) Prior Publication Data

US 2020/0387089 A1 Dec. 10, 2020

(51) Int. Cl.
*G03G 15/10* (2006.01)
*G03G 15/11* (2006.01)
*G03G 21/20* (2006.01)

(52) U.S. Cl.
CPC ..... *G03G 15/107* (2013.01); *G03G 15/11* (2013.01); *G03G 21/206* (2013.01)

(58) Field of Classification Search
CPC ..... G03G 15/107; G03G 15/11; G03G 15/10; G03G 21/206; G03G 21/0088
See application file for complete search history.

(56) References Cited

U.S. PATENT DOCUMENTS 4,623,240 A * 11/1986 Kimura ..... G03G 15/223 399/141
4,731,636 A 3/1988 Howe
4,760,423 A * 7/1988 Holtje ..... B01D 53/02 355/30
5,399,039 A 3/1995 Giles et al.
6,321,053 B1 * 11/2001 Shindo ..... G03G 15/11 399/237
8,801,171 B2 8/2014 DiRubio et al.
9,381,736 B2 7/2016 Landa et al.
(Continued)

OTHER PUBLICATIONS

General Graphic Printing, Apr. 25, 1996, < https://www3.epa.gov/ttnchie1/ap42/ch04/final/c4s09-1.pdf >.
(Continued)

*Primary Examiner* — Walter L Lindsay, Jr.
*Assistant Examiner* — Jessica L Eley
(74) *Attorney, Agent, or Firm* — Dierker & Kavanaugh PC

(57) ABSTRACT

Aspects presented herein are directed towards a carrier evaporator for a Liquid Electrophotography Printing (LEP) system. In an example, the carrier evaporator provides a hot air supply to absorb an evaporated carrier liquid resulting in first air flow comprising a carrier vapour, an evacuator to evacuate at least a portion of the carrier vapour, a heat exchanger to decrease a temperature of the remaining carrier vapour thereby transforming the first air flow to a second airflow comprising carrier particles, and a filter to remove the carrier particles from the second air flow.

14 Claims, 8 Drawing Sheets

(56) References Cited

U.S. PATENT DOCUMENTS

| | | | | |
|---|---|---|---|---|
| 2002/0028090 | A1* | 3/2002 | Shin | G03G 15/11 399/251 |
| 2014/0205307 | A1* | 7/2014 | Tanaka | G03G 21/206 399/43 |
| 2015/0132020 | A1* | 5/2015 | Saito | G03G 21/206 399/92 |
| 2015/0220010 | A1 | 8/2015 | Grinwald et al. | |
| 2016/0004218 | A1* | 1/2016 | Umemoto | G03G 21/206 399/92 |
| 2016/0222232 | A1 | 8/2016 | Landa et al. | |

OTHER PUBLICATIONS

HP Indigo Digital Offset Color Technology, Jul. 4, 2016, < http://www8.hp.com/h20195/V2/getpdf.aspx/4AA1-5248ENW.pdf?ver=1.0 >.

* cited by examiner

CARRIER EVAPORATORS FOR LIQUID ELECTROPHOTOGRAPHY PRINTING

BACKGROUND

Liquid Electrophotography Printing (LEP) is a printing method in which a suspension of a printing dye and a carrier liquid is transferred or printed on to an intermediate print target, sometimes referred to as a blanket. Thereafter, the carrier liquid is evaporated such that the printing dye, substantially free of the carrier liquid, is transferred to the print target.

BRIEF DESCRIPTION OF THE DRAWINGS

The foregoing will be apparent from the following more particular description of the examples provided herein, as illustrated in the accompanying drawings in which like reference characters refer to the same parts throughout the different views. The drawings are not necessarily to scale, emphasis instead being placed upon illustrating the examples provided herein.

DETAILED DESCRIPTION

In the following description, for the purposes of explanation and not limitation, specific details are set forth, such as particular components, elements, techniques, etc. in order to provide a thorough understanding of the examples provided herein. However, the examples may be practiced in other manners that depart from these specific details. In other instances, detailed descriptions of well-known methods and elements are omitted so as not to obscure the description of the examples provided herein.

Example aspects presented herein are directed towards effective and efficient means of evaporating a liquid carrier in a Liquid Electrophotography Printing (LEP) system. Specifically, some aspects described herein make use of increased temperatures during evaporation. The use of a hot air flow allows for a lesser amount of air at, for example, a lower flow rate in the evaporation process thereby utilizing less energy in maintaining the temperature for absorbing the evaporated carrier.

Figure 1:
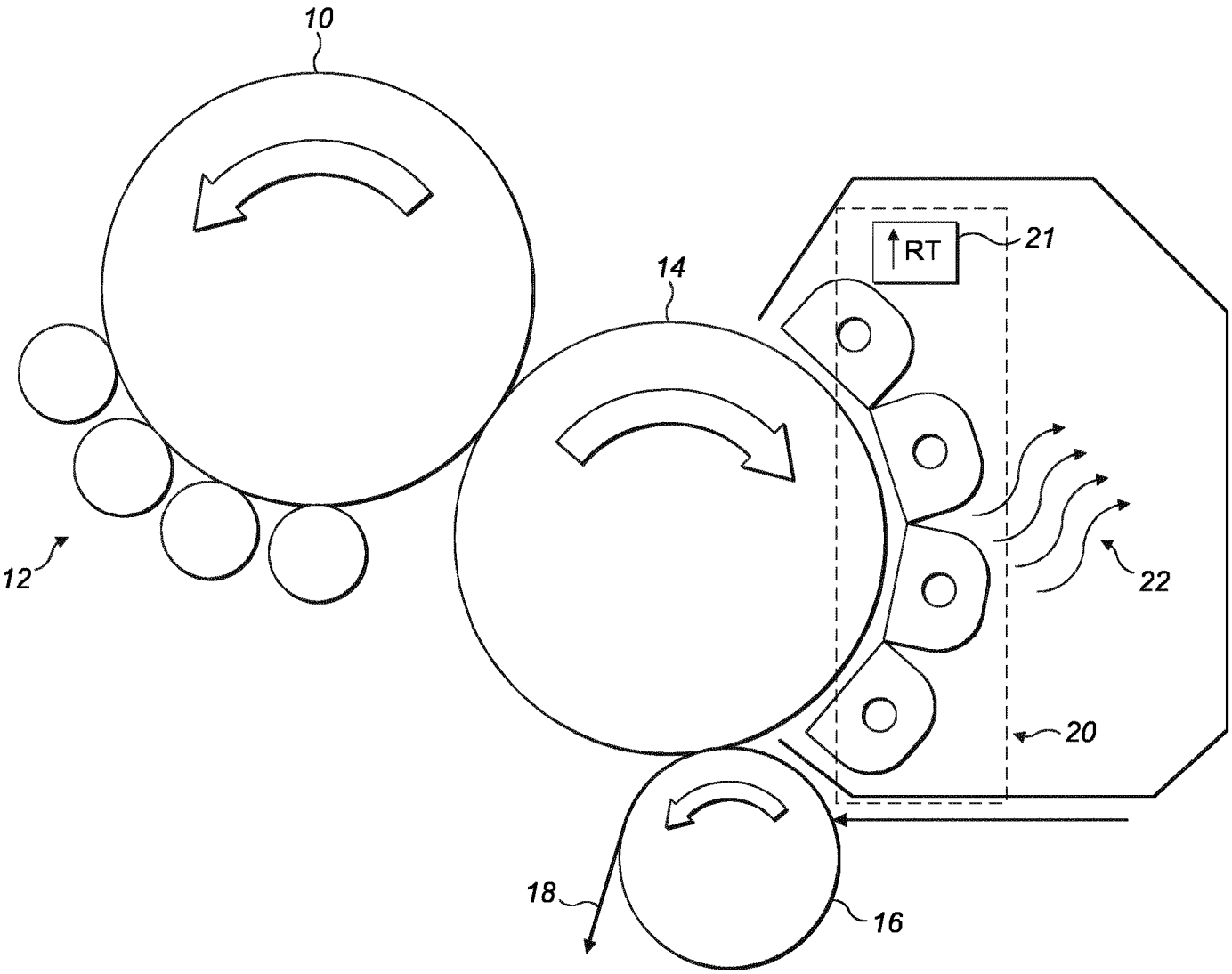
FIG. 1 is an illustrative example of a Liquid Electrophotography Printing (LEP) system, according to some of the examples presented herein.

FIG. 1 illustrates an example of a LEP system. The LEP printing system comprises a first drum 10 in which a suspension of a liquid carrier, for example Isopar L and printing dyes of various colors 12 are supplied. The printing dye may originally be in a powder form. The printing dye will be mixed with the liquid carrier and supplied to the first drum via the use of an electric charge. The first drum will comprise an electric potential in portions where dye is meant to be transferred thereby creating the printing pattern. While the use of a drum is discussed, other elements may also be utilized such as a belt or other transfer member.

The first drum 10 is in proximity to an electrically biasable Intermediate Transfer (ITM) drum 14. The ITM drum 14 receives the suspension of the liquid carrier and the printing dye in the printing pattern from the first drum 10. The liquid carrier is thereafter evaporated and the printing dye, in the printing pattern, is transferred to the print target The evaporation of the liquid carrier is provided via a heating system 20. Once the ITM drum 14 comprising the suspension is rotated towards the heating system 20, the liquid carrier is evaporated 22 such that the printing dye, substantially free of the carrier liquid, is transferred to the transfer drum 16 and subsequently to the print target 18.

During the evaporation of the liquid carrier, the suspension of the liquid carrier and the printing dye is typically heated via a flow of air at room temperature. Once the suspension is heated, the liquid carrier vapour 22 is passed through a filter (not shown) whereby liquid carrier particles, for example, condensed drops of liquid vapour, may be collected and recycled for subsequent printing cycles.

According to the some of the example aspects presented herein, a carrier evaporator for the LEP system is provided. Specifically, some aspects described herein provide for the heating system 20 to provide an air flow which is above room temperature (RT) 21, thereby providing a hot air supply. With the use of the hot air supply, the carrier evaporator provides an efficient and low cost means of evaporating the liquid carrier from the suspension of liquid carrier and the printing dye.

Figure 2:
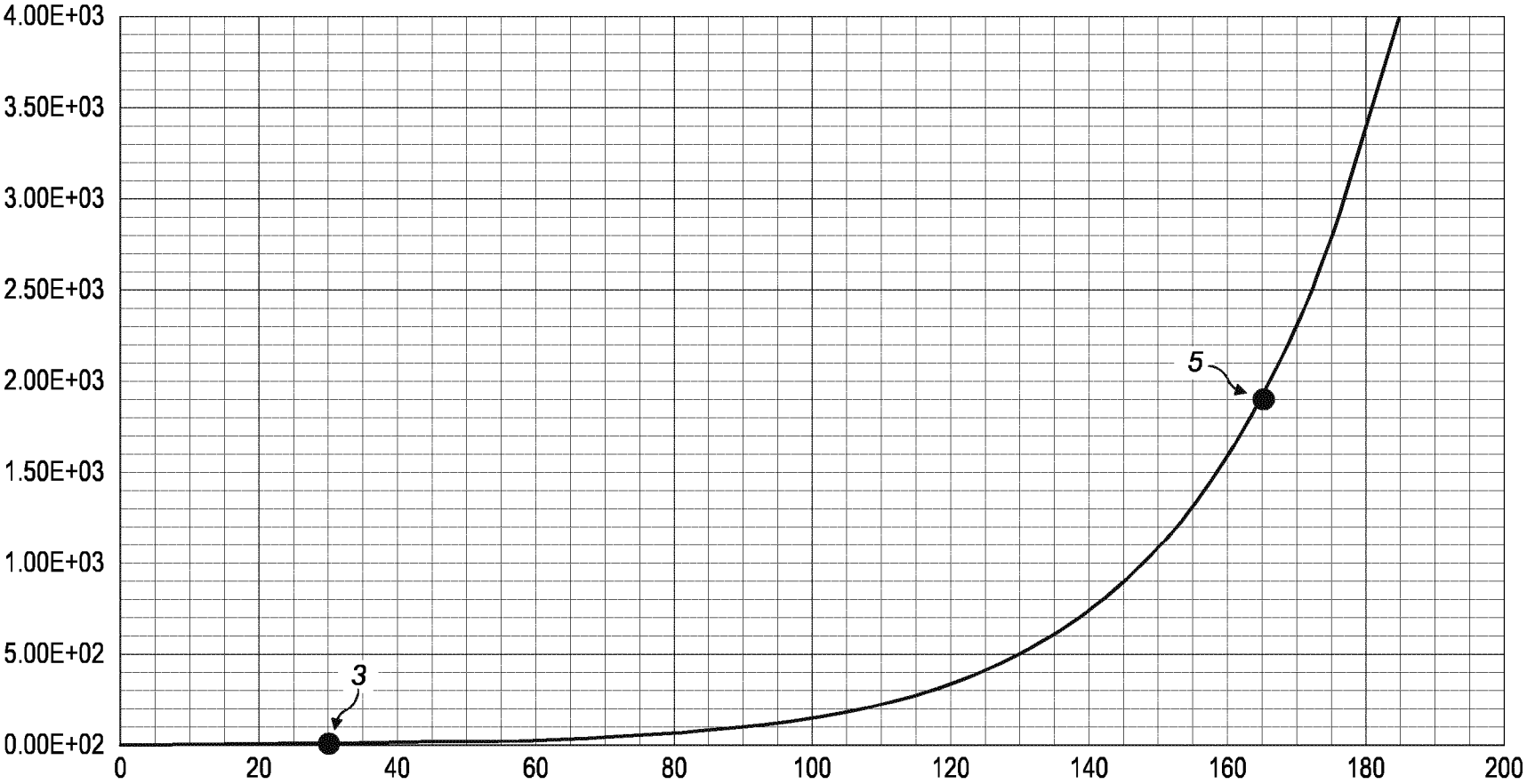
FIG. 2 is a graphical example of an amount of vapour evaporation vs temperature of the air flow used in evaporating the carrier liquid Isopar L, according to some of the examples presented herein.

FIG. 2 illustrates a graph representing the relationship between the concentration of the carrier vapour evaporation (e.g., Isopar L) vs temperature. As shown in the graph, as the temperature of the flow of air which heats the suspension is increased, the concentration of the vapour which is evaporated is also increased. As shown from the graph, the relationship between the concentration of evaporated liquid carrier and the temperature of the applied hot air flow is an exponentially increasing logarithmic function. Data comprised in FIG. 2 has been obtained experimentally using Isopar L as the carrier liquid.

Figure 3:
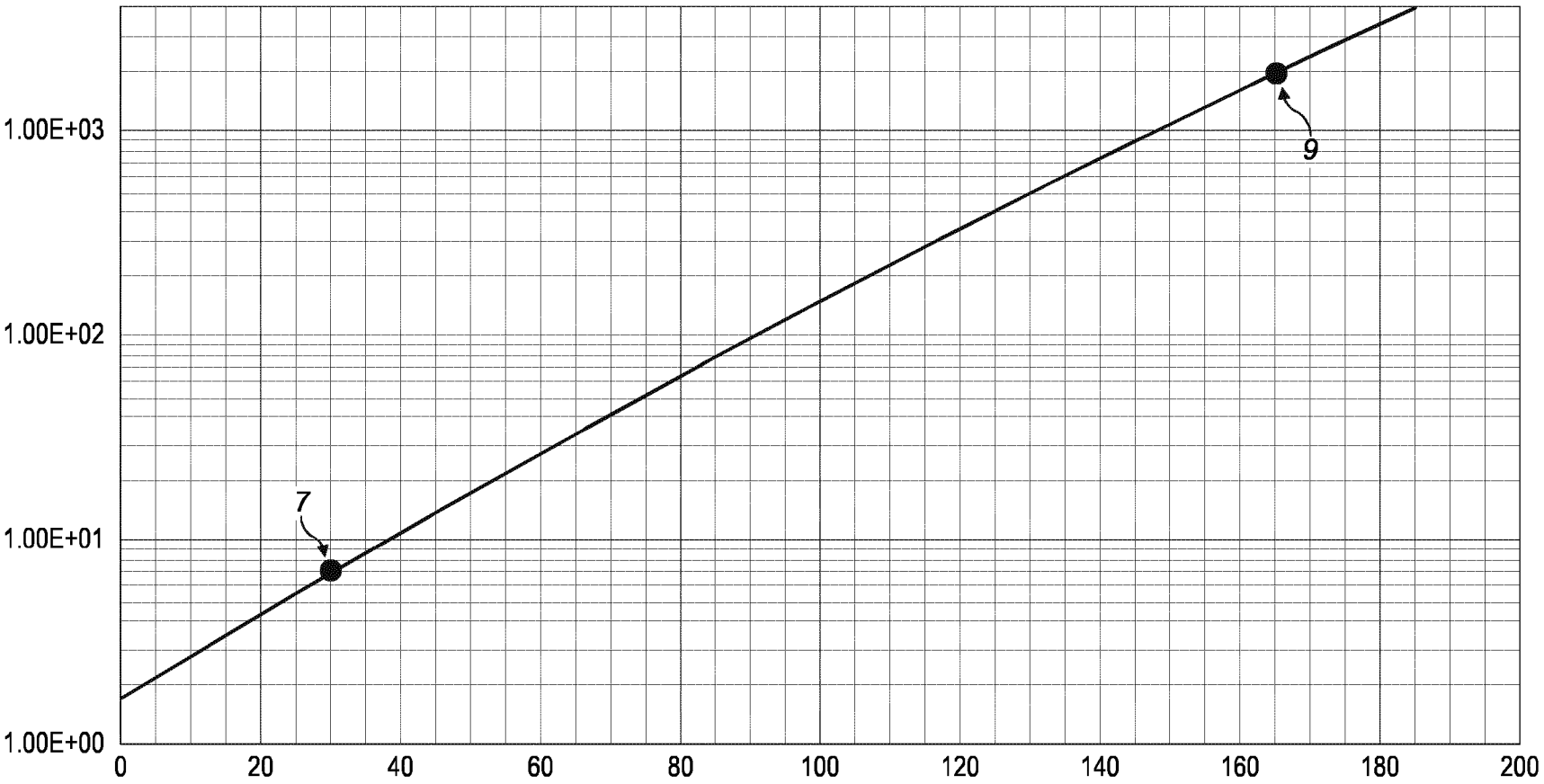
FIG. 3 is a graphical example of an amount of vapour evaporation vs an amount of heat applied to the hot air flow used in evaporating the carrier liquid Isopar L, according to some of the examples presented herein.

FIG. 3 illustrates a graph representing the relationship between the concentration of evaporated carrier vapour vs the amount of heat applied to the air flow utilized in the carrier vapour evaporation. As shown from the graph, the relationship between the concentration of evaporated liquid carrier and the temperature applied to the hot air flow used in the evaporation is an increasing linear function. Data comprised in FIG. 3 has been obtained experimentally using Isopar L as the carrier liquid.

From FIG. 3, it is shown that greater amounts of concentration of the liquid carrier utilize larger amounts of heat to be applied to the hot air flow used in the evaporation. A greater amounts of heat being applied to the hot air flow is typically associated with increased operational costs as more energy will be utilized to provide the increased levels of temperature to the air flow. Therefore, in order to maintain lower production costs, it is common to heat the suspension of carrier liquid and printing dye using an air flow maintained at room temperature.

However, as shown in FIG. 2, since the relationship between the concentration of evaporated liquid carrier and the temperature of the air flow used in the evaporation is an exponential logarithmic function, a substantial amount of additional heat is not utilized for providing a significant increase in the concentration of evaporated carrier vapour. Furthermore, the amount of air which needs to be heated is also reduced According to some aspects, it has been appreciated that an increase in heating temperature results in a greater amount of carrier liquid being evaporated. Points 3 and 7 of FIGS. 2 and 3, respectively, illustrate a working point of LEP evaporators using air flows at room temperature to evaporate liquid carriers. Points 5 and 9 of FIGS. 2 and 3, respectively, illustrate an LEP evaporator using a hot air flow to evaporate liquid carriers, according to some of the aspects described herein.

While it is generally thought that an increase of heating results in increased power and operational costs, aspects presented herein have appreciated that with an increased heating temperature as larger amounts of carrier liquid may be evaporated, lower flow rates may be employed. Thus, a reduced amount of power may be used to provide an air flow in an increased temperature thereby resulting in a greater concentration of evaporated liquid carrier.

Figure 4:
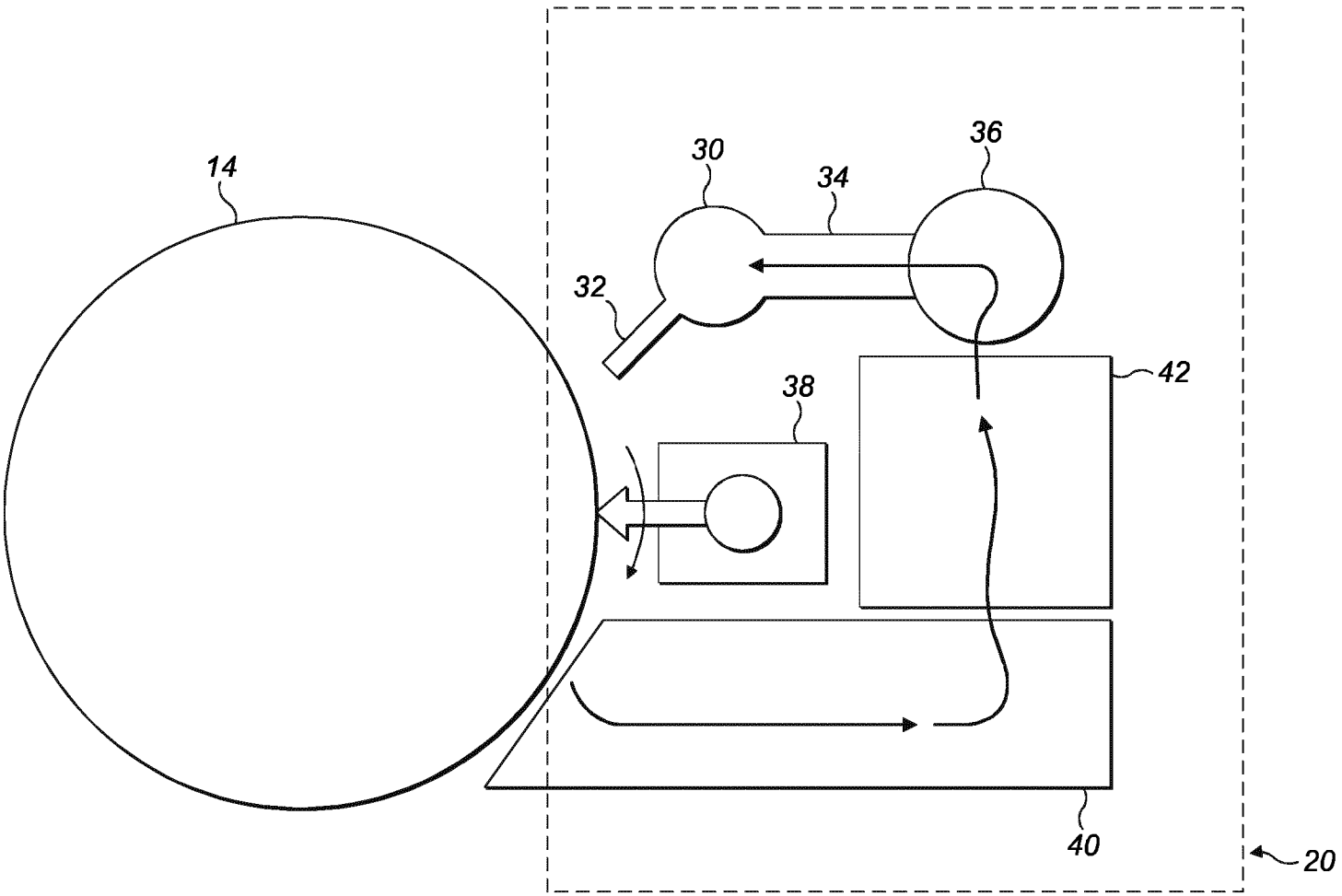
FIG. 4 is a hardware example of a carrier evaporator, according to some of the examples presented herein.

FIG. 4 illustrates a detailed view of the carrier evaporator 20 within the LEP printing system. As discussed in relation to FIG. 1, the ITM drum 14 comprises the suspension of the liquid carrier and the printing dye in a printing pattern. As the surface of the ITM drum 14 passes the carrier evaporator 20, the suspension will be heated and the liquid carrier will be evaporated.

The carrier evaporator 20 provides a low flow rate hot air supply. According to some aspects, the hot air supply is at a temperature higher than room temperature. According to some aspects, the hot air supply is at a temperature of at least 120° C. According to some aspects, the hot air supply is at a temperature within a range of 160° C.-165° C. According to some aspects the hot air supply is provided at a low flow rate. Specifically, the hot air supply may be provided at a flow rate of at most 8 L/s at a printing productivity level of 0.6 $m^2$/s. According to some aspects, the flow rate may be a rate of at most 5 L/$m^2$ of a printing target area.

According to some aspects, the carrier evaporator 20 provides the air supply via a blower/pump 36. The air supply is then heated with the use of an air heater 34, thereby providing the hot air supply 30. According to some aspects, the heater may be a ceramic, tungsten spiral or an infused heater. According to some aspects, a blanket heater 38 may also assist in regulating the temperature of the hot air supply.

The carrier evaporator 20 applies the hot air supply to the surface ITM drum 14 via an air knife 32. The application of the hot air supply results in an absorption of an evaporated carrier liquid resulting in a flow rate of air comprising a carrier vapour. As a lower flow rate is used in the hot air supply, reduced power levels may be achieved. According to some aspects, the evaporator may supply the hot air supply upon receiving a power level of less than 1 kW at a printing productivity level of 0.6 $m^2$/s. According to some aspects, the power level may be less than 0.6 J/$m^2$ of a printing target area.

The carrier vapour is then enters an evacuator and heat exchanger unit 40. The evacuator portion of unit 40 evacuates at least a portion of the carrier vapours. The heat exchanger of unit 40 decreases a temperature of the reaming carrier vapour. The decrease in temperature results in transforming the air flow comprising the carrier vapour to an air flow comprising carrier particles. According to some aspects, the heat exchanger of unit 40 may decrease the temperature of the carrier vapour to 5° C.-10° C.

Figure 5:
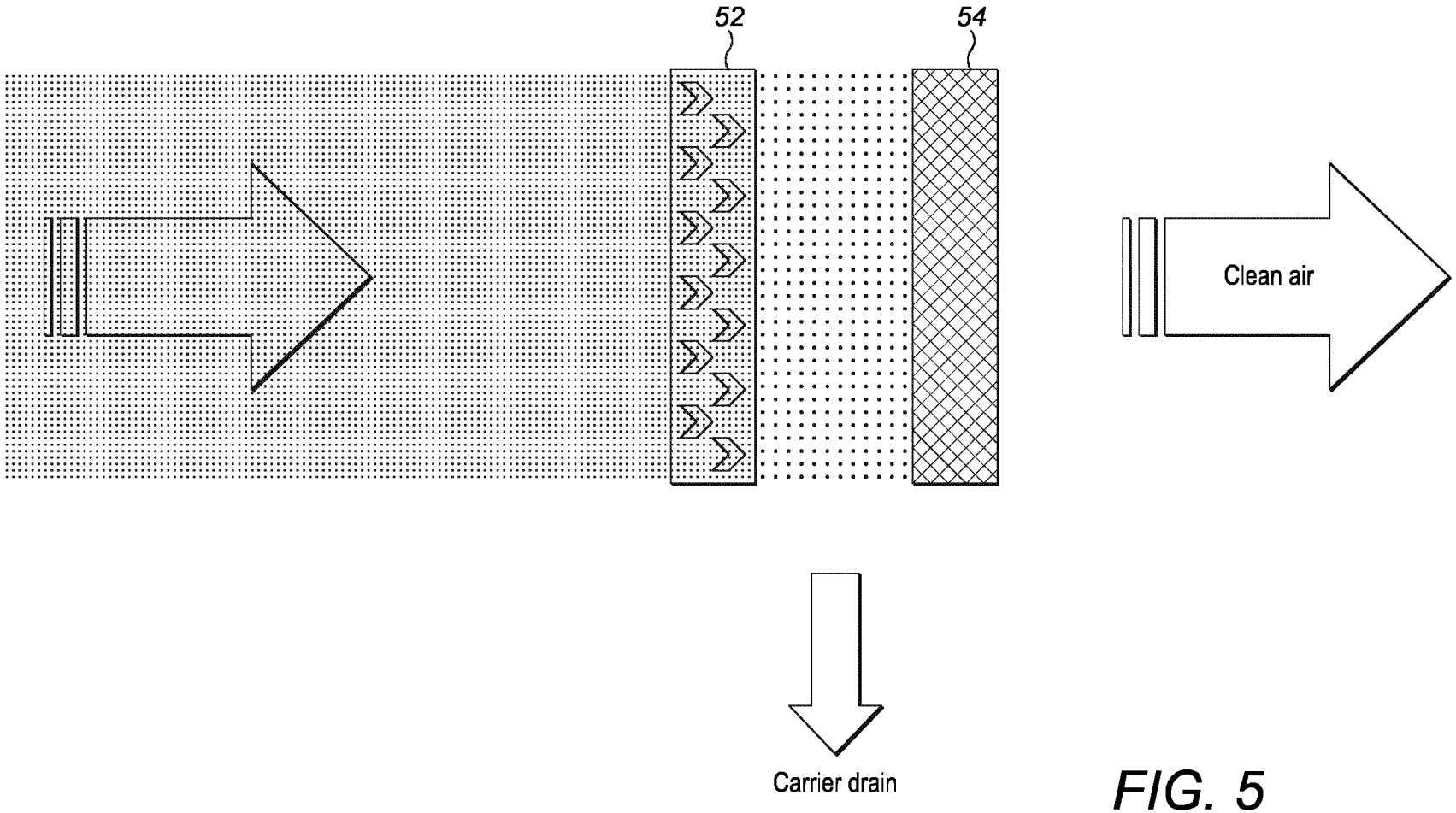
FIG. 5 is an example of a filter in the form of a vain demister.

The air flow comprising the carrier particles thereafter passes through a filter 42. According to some aspects, the filter 42 removes the carrier particles from the air flow. FIG. 5 illustrates a filter in the form of a vain demister 52. As illustrated in FIG. 5, the rate of air passes through the demister 52. The demister 52 separates the carrier particles from the air flow. The separated carrier particles may thereafter pass through a fine filter 54 in which the carrier particles are combined. The combined carrier particles comprise an increased weight and therefore drop, due to the force of gravity, into a carrier drain. The remaining air flow which exists the demister is clear air. The dropped carrier particles are thereafter recycled for future printing.

Figure 6:
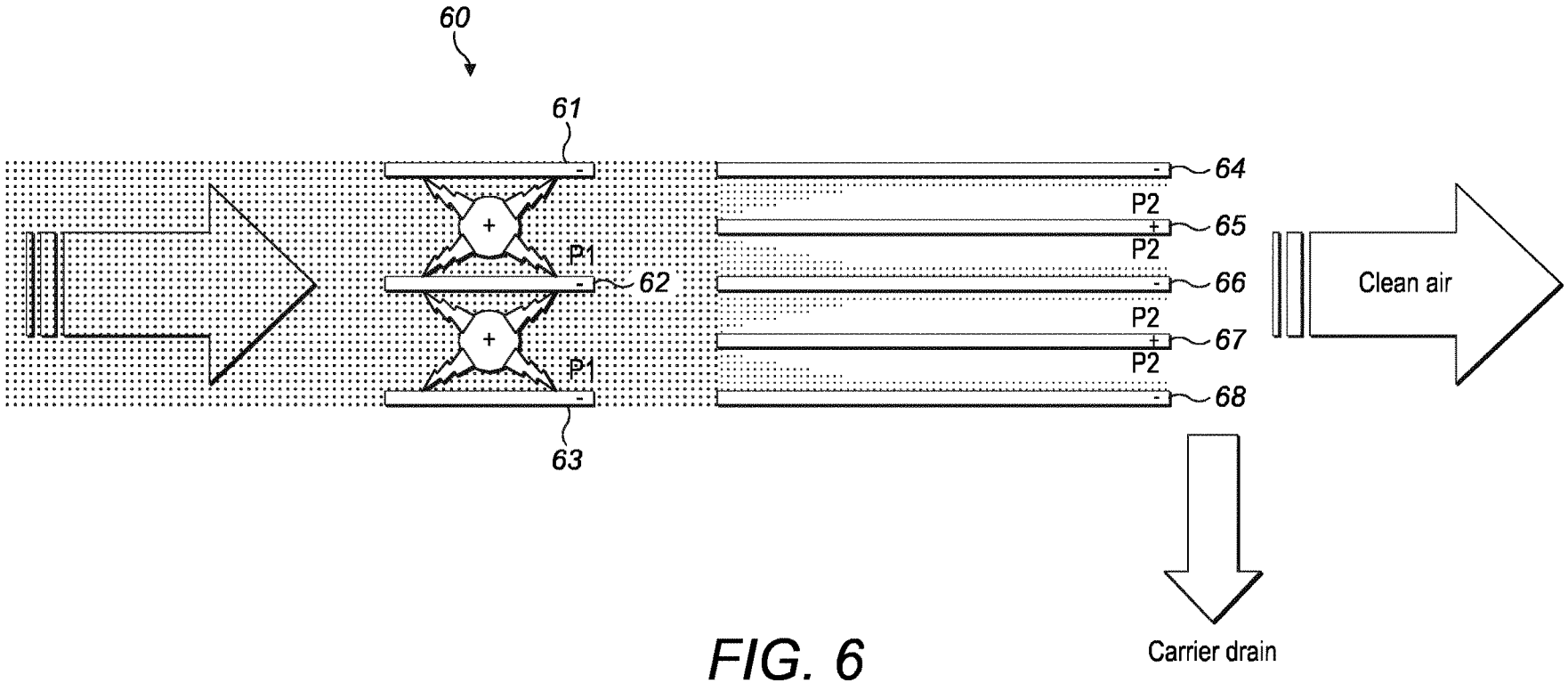
FIG. 6 is an example of a filter in the form of an electrostatic demister, according to some of the example presented herein.

According to some aspects, it is herein appreciated that at lower flow rates, the air flow, comprising the carrier particles, may pass through a filter such as the vain demister of FIG. 5 thereby not providing effective filtering. FIG. 6 illustrates an electrostatic demister 60 which may be used as the filter 42 of FIG. 4.

According to some aspects, the electrostatic demister 60 comprises at least two parallel ionized plates. FIG. 6 illustrates three ionized plates 61-63. Any number of ionized plates (two or more) may be utilized. The parallel ionized plates define a first path P1 for the air flow. According to some aspects, the ionized plates are charged such that as the air flow enters the first path P1, the carrier particles within the air flow become electrostatically charged. Either a positive of negative electrostatic charge may be applied to the carrier particles.

The air flow, comprising the charged carrier particles, may then enter a second path P2 defined by at least two parallel collection plates. FIG. 6 illustrates the use of 5 parallel collection plates 64-68. Any number (two or more) of collection plates may be utilized. According to some aspects, the collection plates form an electric field within the second path P2. As the low flow rate air flow enters the second path P2, the electrostatically charged carrier particles become attracted to a collection plate and thereafter become neutralized. Specifically, the carrier particle will become neutralized by gaining its lost electron or proton.

According to some aspects, the electrostatic demister 60 also comprises a carrier drain 70 which is positioned to collect the neutralized carrier particles as they fall from the collection plates due to the force of gravity. Thereafter, the neutralized carrier particles may be recycled and used for future printing. The electrostatic demister 60 of FIG. 6 provides an efficient and effective means of filtering carrier particles traveling in a low flow rate air flow.

Figure 7:
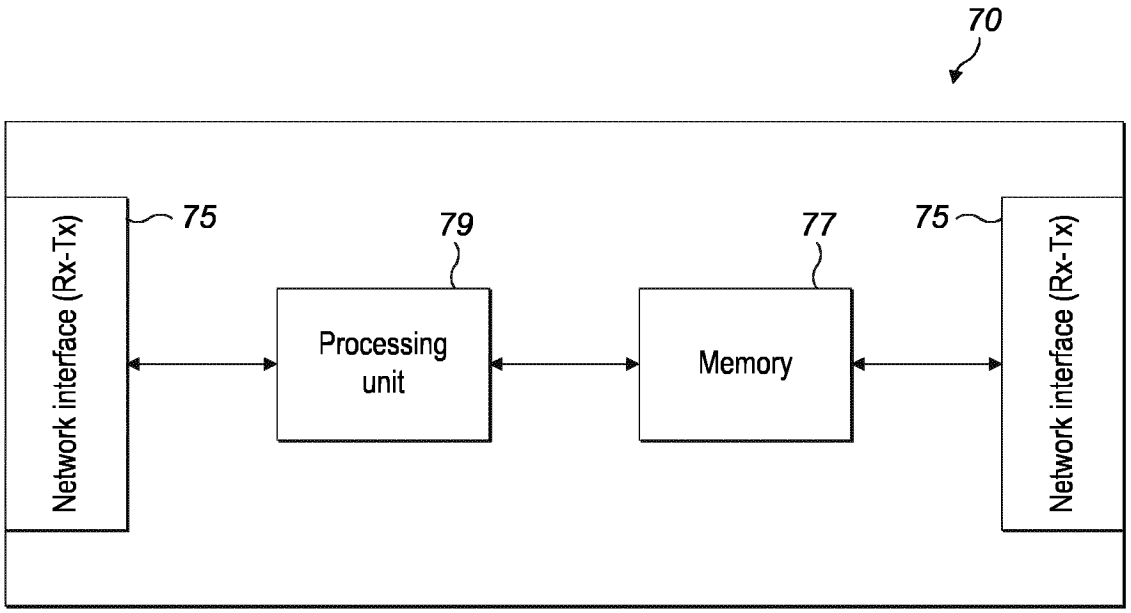
FIG. 7 is a further hardware example of the carrier evaporator, according to some of the examples presented herein.

FIG. 7 illustrates a control unit 73. According to some aspects, the control unit 73 may be used to control operations of the carrier evaporator, including the different components thereof, discussed above. The control unit 73 may comprise any number of network interfaces 75 which may be configured to receive and transmit any form of heating, evaporation or sensing related information and/or instructions. According to some aspects, the network interface may also comprise a single transceiving interface or any number of receiving and/or transmitting interfaces.

The control unit 73 may further comprise at least one memory 77 that may be in communication with the network interfaces. The memory 77 may store received or transmitted data and/or executable program instructions. The memory may also store information relating to the evaporating or heating of the liquid carrier as described herein. The memory may be any suitable type of machine readable medium and may be of a volatile and/or non-volatile type.

The control unit 73 may also comprise at least one processing unit 79 which may be configured to process received information related to the evaporating or heating provided by the evaporator for the LEP printing system. The processing unit may be any suitable computation logic, for example, a microprocessor, digital signal processor (DSP), field programmable gate array (FPGA), or application specific integrated circuitry (ASIC) or any other form of circuitry.

Figure 8:
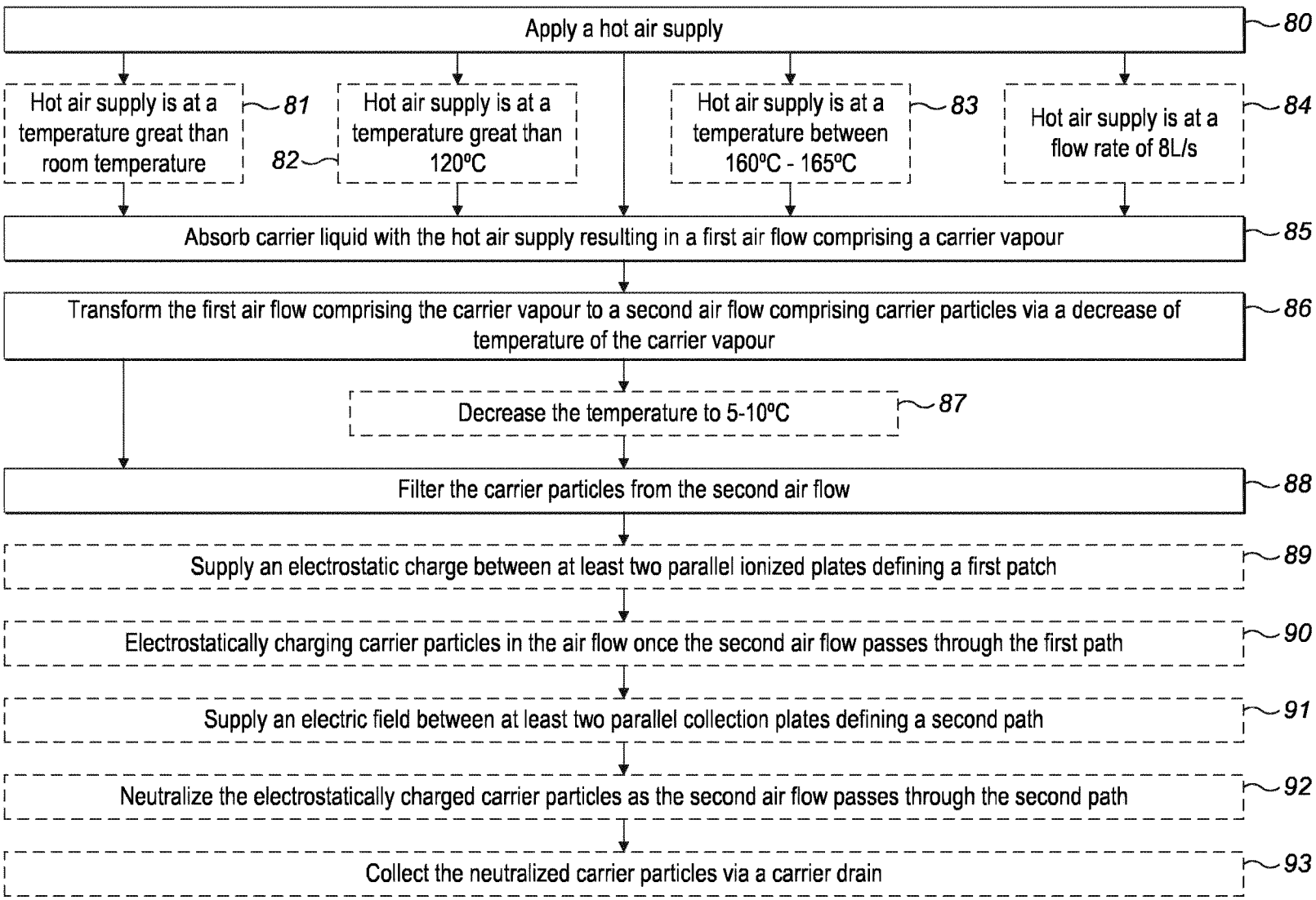
FIG. 8 is a flow diagram illustrating example operations which may be taken by the carrier evaporator, according to some of the examples presented herein.

FIG. 8 illustrates a flow diagram depicting example operations which may be taken by the evaporator, for example comprising the control unit of FIG. 7, in the LEP printing system as described herein.

FIG. 8 comprises some operations which are illustrated in a solid border and some operations which are illustrated with a dashed boarder. The operations which are comprised in a solid border are operations which are comprised in the broadest aspect. The operations which are comprised in a dashed boarder are example aspects which may be comprised in, or a part of, or are further operations which may be taken in addition to the operations of the broader example aspects. The operations of FIG. 8 need not be performed in order. Furthermore, not all the operations need to be performed. The example operations may be performed in any order and in any combination.

Operation 80

The evaporator is configured to apply a hot air supply. The heater (e.g., at least any one of components 30-38) may be configured to supply or maintain the temperature of the hot air supply. The processing unit may be configured to provide computer readable instructions to supply such a hot air supply.

According to some aspects the use of a hot air flow allows for less air to be used as compared to systems with rely on air at room temperature. Furthermore, less energy and system resources are utilized to maintain the temperature of the air flow above room temperature. According to some aspects, the hot air supply and resulting air flow comprise low flow rates.

Example Operation 81

According to some aspects, the applying 80 further comprises applying 81 the hot air supply at a temperature greater than room temperature. The heater (e.g., at least any one of components 30-38) may be configured to supply or maintain the temperature of the hot air supply at a temperature above room temperature. The processing unit may be configured to provide computer readable instructions to supply such a hot air supply at a temperature above room temperature.

Example Operation 82

According to some aspects, the applying 80 further comprises applying 82 the hot air supply at a temperature greater than 120° C. The heater (e.g., at least any one of components 30-38) may be configured to supply or maintain the temperature of the hot air supply at a temperature above 120° C. The processing unit may be configured to provide computer readable instructions to supply such a hot air supply at a temperature above 120° C.

Example Operation 83

According to some aspects, the applying 80 further comprises applying 83 the hot air supply at a temperature between 160° C.-165° C. The heater (e.g., at least any one of components 30-38) may be configured to supply or maintain the temperature of the hot air supply at a temperature between 160° C.-165° C. The processing unit may be configured to provide computer readable instructions to supply such a hot air supply at a temperature between 160° C.-165° C.

Example Operation 84

According to some aspects, the applying 80 further comprises applying 84 the hot air supply at a flow rate of at most 8 L/s at a printing productivity level of 0.6 $m^2/s$. The heater (e.g., the blower/pump 36) may be configured to supply the hot air supply at a rate of at most 8 L/s at a printing productivity level of 0.6 $m^2/s$. The processing unit may be configured to provide computer readable instructions to supply such a hot air supply at a rate of at most 8 L/s at a printing productivity level of 0.6 $m^2/s$.

Operation 85

The evaporator is further configured to absorb 85 a carrier liquid with the hot air supply, where the absorbing results in a first air flow comprising a carrier vapour. The suction of the unit 40 is configured to absorb the carrier liquid with the hot air supply. The processing unit is configured to provide computer readable instructions to control the absorbing.

As explained above, the absorbing of the carrier liquid may be provided via the application of heat to the blanket comprised on the ITM drum of the LEP printing system. According to some aspects, the liquid carrier may be a dielectric volatile liquid, for example mineral oil. As example of such a mineral oil is an isoparaffin such as Isopar L.

Operation 86

The evaporator is further configured to transform the first air flow comprising the carrier vapour to a second air flow comprising carrier particles via a decrease of temperature of the carrier vapour. The heat exchanger of unit 40 is configured to transform the first air flow comprising carrier vapour to a second air flow comprising carrier particles via the decrease of temperature of the carrier vapour. The processing unit is configured to provide computer readable instructions to facilitate the decrease of temperature. According to some aspects, an evacuator may also be used to evacuate a portion of the carrier vapour prior to the decrease in temperature.

Example Operation 87

According to some aspects, the transforming 86 may further comprise decreasing 87 the temperature of the first air flow comprising the carrier vapour to 5° C.-10° C. The heat exchanger of unit 40 may decrease the temperature of the first air flow comprising the carrier vapour to 5° C.-10° C. The processing unit may be configured to provide computer readable instructions to facilitate the decrease of temperature to 5° C.-10° C.

Operation 88

The evaporator is further configured to filter 88 the carrier particles from the second air flow. A filter 42 is configured to filter the carrier particles from the second air flow. The processing unit may be configured to provide computer readable instructions to facilitate the filtering of the carrier particles.

Example Operation 89

According to some aspects, the filtering 88 may further comprise supplying 89 an electrostatic charge between at least two parallel ionized plates defining a first path. Ionized plates (e.g., plates 61-63) of an electrostatic demister 60 may be configured to supply the electro static charge. The processing unit may be configured to provide computer readable instructions to supply the electrostatic charge between the at least two parallel ionized plates defining the first path. This example operation is further described in at least FIG. 6.

Example Operation 90

According to some aspects, the filtering 88 and supplying 89 may further comprise electrostatically charging 90 carrier particles in the second air flow once the second air flow passes through the first path. The at least two parallel ionized plates (e.g., plates 61-63) of an electrostatic demister 60 may be configured to electrostatically charge the carrier particles in the second air flow. The processing unit may be configured to provide computer readable instructions for electrostatically charging the carrier particles.

Example Operation 91

According to some aspects, the filtering 88, supplying 89 and electrostatically charging 90 may further comprising supplying 91 an electric field between at least two parallel collection plates defining a second path. At least two collection plates (e.g., collection plates 64-68) may supply the electric field. The processing unit may be configured to provide instructions for supplying the electric field between the at least two parallel collection plates.

Example Operation 92

According to some aspects, the filtering 88, supplying 89, electrostatically charging 90 and supplying 91 may further comprising neutralizing 92 the electrostatically charged carrier particle as the second air flow passes through the second path and the electrostatically charged particle becomes attracted to one of the parallel collection plates. The at least two collection plates of the electrostatic demister may neutralize the electrostatically charged carrier particle. The processing unit may provide computer readable instructions to control an electric field in order to neutralize the electrostatically charged carrier particle as the air flow passes through the second path and the electrostatically charged particle becomes attracted to one of the parallel plates.

Example Operation 93

According to some aspects, the filtering 88, supplying 89, electrostatically charging 90, supplying 91 and neutralizing 92 may further comprise collecting 93 the neutralized carrier particles via a carrier drain. The processing unit may provide computer readable instructions to facilitate the collecting of the neutralized carrier particles.

Throughout the description and claims of this specification, the words "comprise" and "contain" and variations of them mean "including but not limited to", and they are not intended to (and do not) exclude other moieties, additives, components, integers or examples. Throughout the description and claims of this specification, the singular encompasses the plural unless the context otherwise expresses singular use similar. In particular, where the indefinite article is used, the specification is to be understood as contemplating plurality as well as singularity, unless the context otherwise expresses singular use similar.

Features, integers, characteristics, groups described in conjunction with a particular aspect or examples are to be understood to be applicable to any other aspect or examples described herein unless incompatible therewith. All of the features disclosed in this specification (including any accompanying claims, abstract and drawings), and/or all of the operations of any method or process so disclosed, may be combined in any combination, except combinations where at least some of such features and/or operations are mutually exclusive. The examples presented herein are not restricted to the details of any foregoing aspects. The examples extends to any novel one, or any novel combination, of the features disclosed in this specification (including any accompanying claims, abstract and drawings), or to any novel one, or any novel combination, of the operations of any method or process so disclosed.

The invention claimed is:

1. A carrier evaporator for a Liquid Electrophotography Printing printing system, the carrier evaporator comprising:

a heater to provide a hot air supply at a flow rate of at most 8 L/s to absorb an evaporated carrier liquid resulting in first air flow comprising a carrier vapour, wherein the heater provides the hot air supply at a temperature of at least 120° C.;

an evacuator to evacuate at least a portion of the carrier vapour;

a heat exchanger to decrease a temperature of the remaining carrier vapour thereby transforming the first air flow to a second airflow comprising carrier particles; and a filter to remove the carrier particles from the second air flow.

2. The carrier evaporator of claim 1, wherein the heater provides the hot air supply at a temperature within a range of 160° C.-165° C.

3. The carrier evaporator of claim 1, wherein the filter is an electrostatic demister.

4. The carrier evaporator of claim 3, wherein the electrostatic demister comprises:

at least two parallel ionized plates defining a first path for the air flow comprising the carrier particles, the at least two parallel ionized plates to supply an electrostatic charge to the carrier particles traveling through the first path;

at least two parallel collection plates defining a second path for the air flow comprising the electrostatically charged carrier particles, the at least two parallel collection plates to form an electric field within the second path such that as the air flow enters the second path, the electrostatically charged carrier particles are attracted to a parallel collection plate and neutralized; and a carrier drain to collect the neutralized carrier particles.

5. The carrier evaporator of claim 1, wherein the suction and heat exchanger is to decrease the temperature of the carrier vapour to 5-10° C.

6. The carrier evaporator of claim 1, wherein the heater is a ceramic, tungsten spiral or an infused heater.

7. The carrier evaporator of claim 1, wherein the heater is to provide the hot air supply upon receiving a power of less than 1 kW at a printing productivity level of 0.6 m2/s.

8. The carrier evaporator of claim 1, wherein the carrier liquid is Isopar L.

9. A Liquid Electrophotography Printing system comprising a carrier evaporator, the evaporator comprising:

a heater to provide a hot air supply at a flow rate of at most 8 L/s to absorb an evaporated carrier liquid resulting in first air flow comprising a carrier vapour, wherein the heater provides the hot air supply at a temperature of at least 120° C.;

an evacuator to evacuate at least a portion of the carrier vapour;

a heat exchanger to decrease a temperature of the remaining carrier vapour thereby transforming the first air flow to a second airflow comprising carrier particles; and a filter to remove the carrier particles from the second air flow.

10. The system of claim 9, wherein the filter is an electrostatic demister.

11. The system of claim 10, wherein the electrostatic demister further comprises:

at least two parallel ionized plates defining a first path for the air flow, the at least two parallel ionized plates to supply an electrostatic charge to the carrier particles in the air flow traveling through the first path;

at least two parallel collection plates defining a second path for the air flow comprising the electrostatically charged carrier particles, the at least two parallel collection plates to form an electronic field within the second path such that as the air flow enters the second path, carrier particles are attracted to a parallel collection plate and neutralized; and a carrier drain to collect the neutralized carrier particles.

12. A method for a Liquid Electrophotography Printing system having an intermediate transfer member, the method comprising:

blowing air having a temperature of at least 120° C. on to the intermediate transfer member at a flow rate less than or equal to 8 L/s;

evacuating air away from the intermediate transfer member;

cooling the evacuated air; and filtering the cooled air.

13. The method of claim 12, wherein the cooling comprises cooling the evacuated air to 5° C.-10° C.

14. The method of claim 13, wherein the blowing comprises blowing air having a temperature of 160° C.-165° C.

* * * * *